US007137522B2

(12) United States Patent
Dubois

(10) Patent No.: US 7,137,522 B2
(45) Date of Patent: Nov. 21, 2006

(54) COLLAPSIBLE STORAGE AND TRANSPORT CONTAINER

(75) Inventor: Jean-Marc Dubois, Bremgarten (CH)

(73) Assignee: Georg Utz Holding AG, Bremgarten (CH)

( * ) Notice: Subject to any disclaimer, the term of this patent is extended or adjusted under 35 U.S.C. 154(b) by 357 days.

(21) Appl. No.: 10/694,488

(22) Filed: Oct. 27, 2003

(65) Prior Publication Data

US 2004/0084447 A1 May 6, 2004

(30) Foreign Application Priority Data

Nov. 5, 2002 (DE) ..... 102 51 744

(51) Int. Cl.
*B65D 6/18* (2006.01)
*B65D 21/032* (2006.01)
*B65D 21/036* (2006.01)

(52) U.S. Cl. ..... 220/6; 206/509; 217/15; 220/4.28

(58) Field of Classification Search ..... 220/6, 220/666, 7, 4.28; 206/511, 508, 509; 217/15, 217/47

See application file for complete search history.

(56) References Cited

U.S. PATENT DOCUMENTS 1,488,418 A * 3/1924 Walther ..... 220/7
2,755,955 A * 7/1956 Gordon ..... 220/6
3,870,185 A * 3/1975 Sanders et al. ..... 220/6
4,214,669 A * 7/1980 McQuiston ..... 220/6
4,630,745 A * 12/1986 Shiotani ..... 220/6
4,863,056 A * 9/1989 Inayama ..... 220/6
5,038,953 A * 8/1991 Radar ..... 220/6
5,190,179 A * 3/1993 Richter et al. ..... 220/6
5,294,027 A * 3/1994 Plastina ..... 224/553
5,429,261 A * 7/1995 Machino ..... 220/7
6,354,487 B1 * 3/2002 Muise, Jr. ..... 229/125.28

FOREIGN PATENT DOCUMENTS

DE 28 53 558 6/1980
DE 94 16 831 12/1994
DE 295 00 992 4/1995
DE 298 09 950 8/1998

* cited by examiner

*Primary Examiner*—Nathan J. Newhouse
*Assistant Examiner*—Niki M. Eloshway
(74) *Attorney, Agent, or Firm*—Collard & Roe, P.C.

(57) ABSTRACT

A collapsible storage and transport container made of plastic, has a bottom, lengthwise and crosswise side walls that rise vertically from it, opposite one another in pairs, in the operating position, and a top end frame connected with the side walls in articulated manner, in the region of their top edge. The lengthwise side walls are mounted on the bottom and on the end frame, in articulated manner, about longitudinal axes that run parallel to one another and to the plane of the bottom, and can be folded about a center longitudinal axis. The crosswise side walls are structured in one piece, in each instance, and are arranged to pivot about a crosswise axis that is parallel to the plane of the bottom, after a lock has been released, from their upright position into a horizontal collapsed position. The crosswise side walls are mounted to pivot in the region of the bottom, and are provided, at their free top edge, with devices to secure them in place with a positive lock, on the top end frame.

9 Claims, 7 Drawing Sheets

COLLAPSIBLE STORAGE AND TRANSPORT CONTAINER

CROSS REFERENCE TO RELATED APPLICATIONS

Applicant claims priority under 35 U.S.C. §119 of German Application No. 102 51 744.4 filed Nov. 5, 2002.

BACKGROUND OF THE INVENTION

1. Field of the Invention

The present invention relates to a collapsible storage and transport container made of plastic.

2. The Prior Art

A collapsible storage and transport container is known, for example, from DE 295 00 992 U1. In the container described there, the crosswise side walls are connected with the top end frame in articulated manner, so that when the container is set up, they automatically fall into the upright position, but must then be fastened in place in the bottom region, using force.

Since valuable and/or sensitive goods must sometimes be transported in such containers, particularly in the industrial sector, these containers must also be provided with a security device that prevents the containers from being opened by unauthorized persons.

This is done, in the case of the known container, by means of latches that can be activated counter to a spring force, but these do not necessarily provide protection against manipulation.

Furthermore, the handling of such containers, particularly when collapsing them, is complicated.

SUMMARY OF THE INVENTION

It is an object of the present invention to structure a container of this type so that manipulations of the closure security device are made difficult and handling of the container is also facilitated.

In accordance with the invention, these and other objects are achieved by providing a collapsible storage and transport container in which the crosswise side walls are mounted in the region of the bottom of the container, in articulated manner, and are provided with devices for fastening them in place with a positive lock, at their free top edges on the top end frame which is connected with the side walls.

The essential novelty of the container according to the invention can therefore be seen in that the crosswise side walls flap down onto the bottom when the container is collapsed, thereby facilitating handling of the container during the collapsing process.

In this connection, it is particularly advantageous if, in accordance with a preferred embodiment, at least one tab is provided on the free top edges of the crosswise side walls, which tab can be fastened in place in the top end frame, with a positive lock, in a recess that is complementary to this tab.

When the container is set up into its operating position, the tab(s) on the crosswise side walls thereby come(s) to rest in the corresponding recesses in the top end frame, and in this position, measures can be taken so that a positive-lock connection between the tabs and the container comes about.

This is done, in a first variant embodiment, by structuring the tab essentially in cylindrical shape. In this embodiment, the tab in the upright position of the crosswise side wall, projects beyond the recess in the top end frame so that the projecting part of the tab of one of the crosswise side walls projects into a recess on the underside of a lid that closes the container, while the projecting part of the tab of the opposite crosswise side wall rests against a ridge formed on the underside of the lid.

In this way, the result is achieved that the lid not only closes the container and makes the contents inaccessible, but also, the previously mentioned positive-lock connection between the tab and the container comes about.

In a second variant embodiment, the tab is structured essentially in cylindrical shape and, in the upright position of the crosswise side wall, projects beyond the holder in the top end frame so that the projecting part of the tab projects into a recess in the bottom of a container that is set onto the container and has the same construction as this container.

This second container thereby closes the first container, so that either this second container can be closed with the lid described above, or another container is set onto the second container. This third container is then closed with a lid.

For reasons of stability, it is provided, according to a further embodiment, that two tabs are provided at each crosswise side wall.

To increase the security against unauthorized opening of the container according to the invention, it is provided, according to a further embodiment, that a projection that projects outward at a right angle is provided at the free top edge of the crosswise side walls, in each instance. Each projection can be inserted through a respective complementary slit in the top end frame, and can be locked in place there by means of a lead seal.

In this connection, it is provided, in particularly advantageous manner, according to a further embodiment, that bores that align with one another are present for the wire of the lead seal, not only in the lid but also in the top end frame and in the projection. Raised nubs are provided to the right and the left of the bore, in the lid, on its underside, which nubs correspond with corresponding depressions in the top end frame.

By means of the bores that align with one another, the result is assured that a connection between the lid, the crosswise side wall, and the top end frame will come about by means of the wire of the lead seal or an insertable lead seal. The nubs provided on the underside of the lid come into engagement with the corresponding depressions, so that self-centering of the lid takes place, on the one hand, and securing of its position takes place, on the other hand. This also makes it possible to absorb crosswise forces to relieve stress on the lead seal.

In order to securely attach the lid on the container according to the invention, it is provided, according to a further embodiment, that slit-shaped recesses are provided in the top end frame, which is structured as a hollow profile, into which recesses the locking tabs that are provided at the underside of the lid can be inserted.

One possible attachment of the lid in these slit-shaped recesses is provided by a further embodiment. In this embodiment, the locking tabs are structured in hook shape, so that they can be inserted vertically into the slits in the top end frame and, after the lid has been shifted horizontally, they engage under the top wall of the end frame.

In this connection, the ridge mentioned in the first variant embodiment discussed previously is structured as a slanted plane, at least in parts, so that when the lid is lowered into the slit-shaped recesses, and when it is moved horizontally, the tabs present on the crosswise side walls move into the corresponding recesses, on the one hand, and the tabs of the opposite crosswise side wall come to rest in front of this slanted plane, on the other hand.

This causes the lid to sit immovably on the container even before a lead seal is applied.

According to a further embodiment, the top end frame has a lower shoulder that points into the interior of the container, on its sides assigned to the crosswise side walls, in which shoulder the opening(s) that is/are open towards the interior of the container, to hold the tab(s), is/are arranged.

This arrangement has several advantages. First this arrangement makes it possible for additional tabs to be molded onto the lid, in the insertion direction, on the front, which can move into corresponding recesses in the top end frame, above the shoulder. Second, this arrangement improves the stackability of the containers, since the containers in question generally have a design of the bottom in which the bottom edge region is also structured in shoulder shape. This means that this edge region sits on the top end frame, while the remaining bottom region projects into the container interior of the container arranged underneath it.

In a lid variant, recesses may be provided in the free top edge of the crosswise side walls, which correspond with tabs that project from the lid edges at a right angle. In this way, after the crosswise side walls are set upright, the lid is set onto the container so that the tabs penetrate into the recesses, which also causes a positive-lock connection to come about. The method of securing the lid results from what has already been said.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

FIG. 7 shows an embodiment of a crosswise side wall and lengthwise side wall with top end frame and lid set on.

DETAILED DESCRIPTION OF PREFERRED EMBODIMENTS

Figure 1:
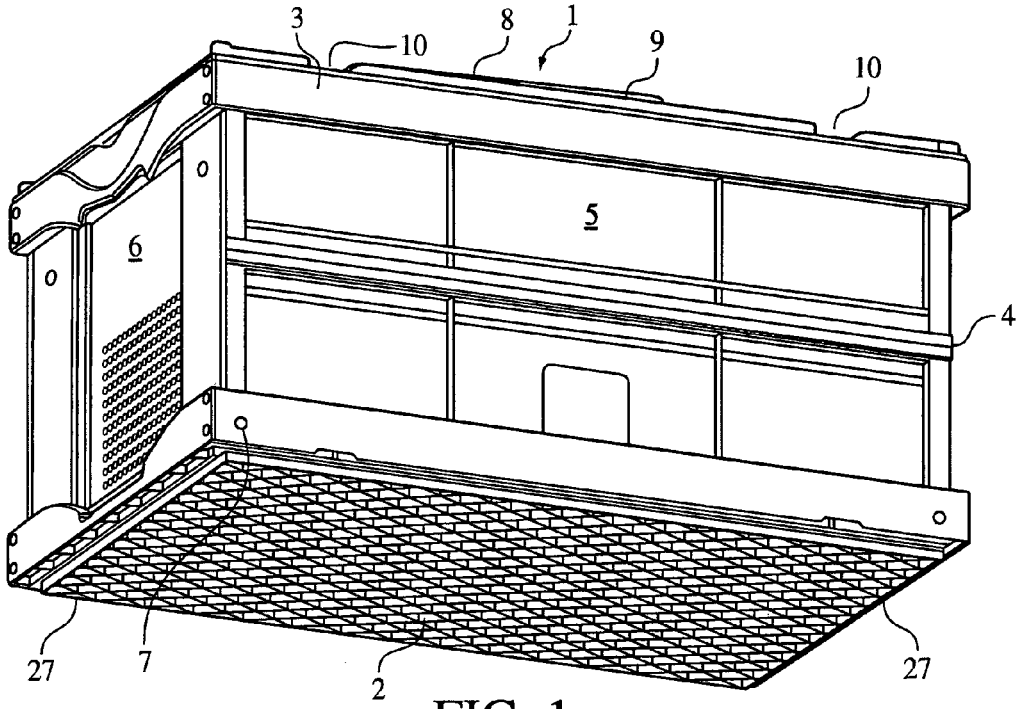
FIG. 1 is a perspective view of a container in the operating position (in a partially sectional view).
Figure 2:
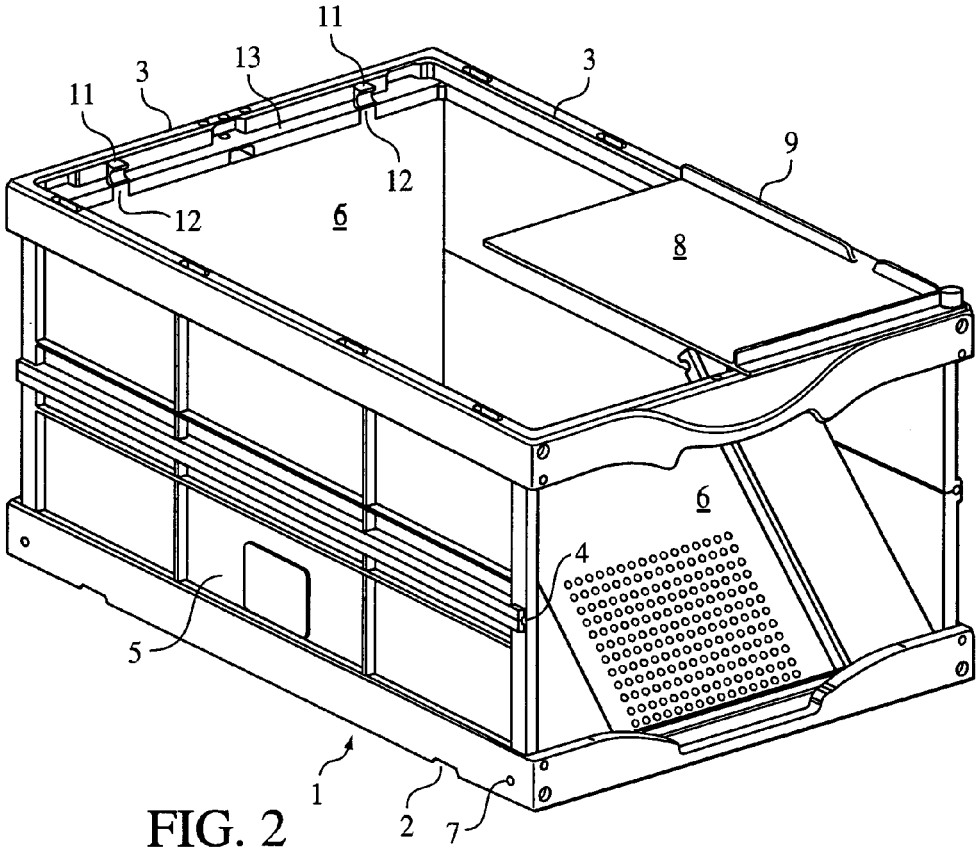
FIG. 2 shows a container according to FIG. 1 with the crosswise side wall half upright (in a partially sectional view).

Turning now in detail to the drawings, FIGS. 1 and 2 show a collapsible container according to the invention indicated, in general, with the reference symbol 1. Container 1 has a bottom 2 and a top end frame 3. Side walls 5 that can be folded into the interior of the container about an axis 4 are mounted, in articulated manner, on the top end frame 3, on the one hand, and on the bottom 2, on the other hand, so that they can be folded up and down.

The container is completed by two crosswise side walls 6, which are structured in one piece, and are structured to fold into the interior of the container about axes arranged in the bottom region 7.

A lid 8 serves to close container 1. On its top side, lid 8 has a rib 9 that runs around the circumference, which rib is interrupted at 10. The interruptions 10 serve as a holder for a belt for locking the container(s).

Figure 3:
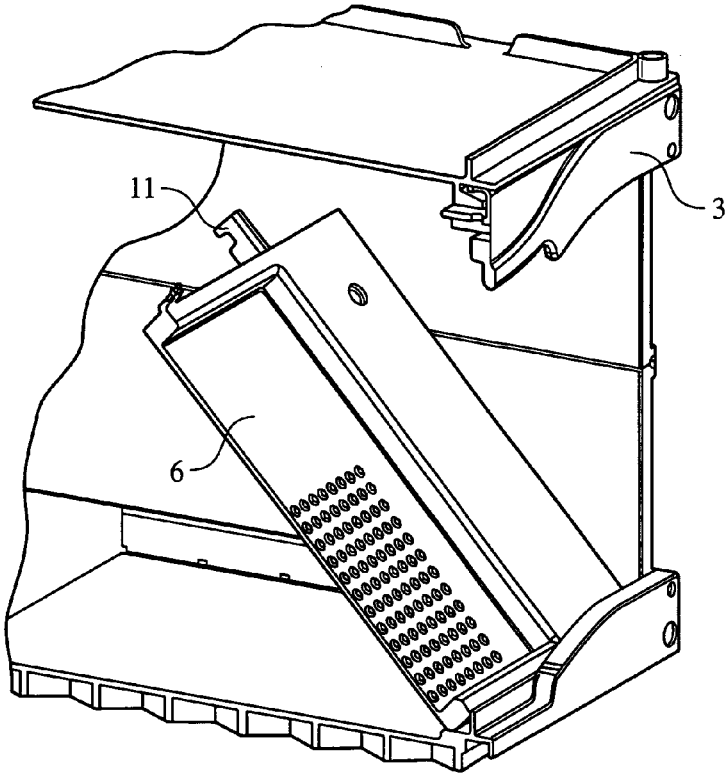
FIG. 3 shows a container according to FIG. 2 in a cut-open view.
Figure 4:
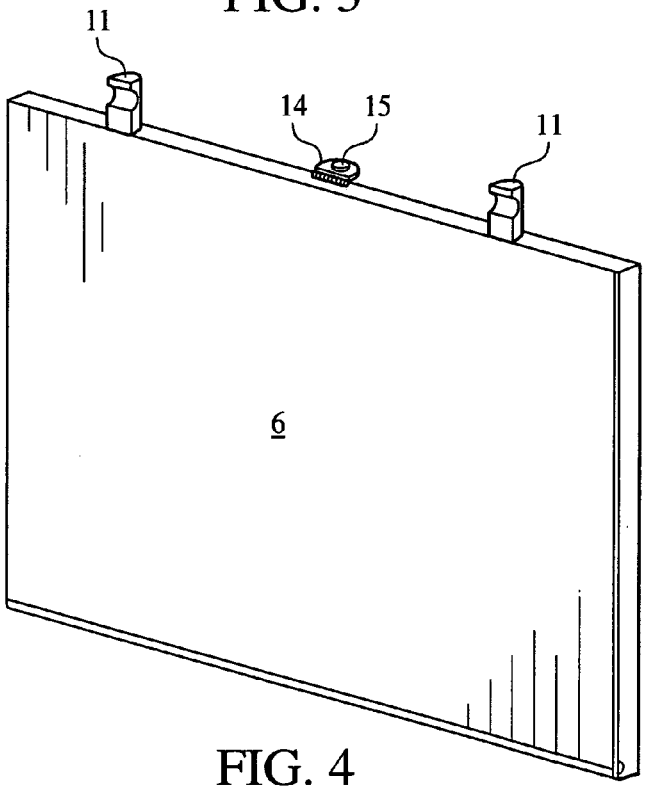
FIG. 4 shows an embodiment of a crosswise side wall.

As is evident from FIG. 2, but more clearly from FIGS. 3 and 4, tabs 11 are molded onto the top edge of the crosswise side walls 6, which are introduced into corresponding recesses 12 in the top end frame 3. Tabs 11 project beyond a shoulder 13 that is formed in top end frame 3, so that the free end of tab 11 lies in the plane that passes through top end frame 3.

In addition to tabs 11, a projection 14 that projects outward at a right angle is molded onto crosswise side wall 6, and a bore 15 is provided in it.

Figure 5:
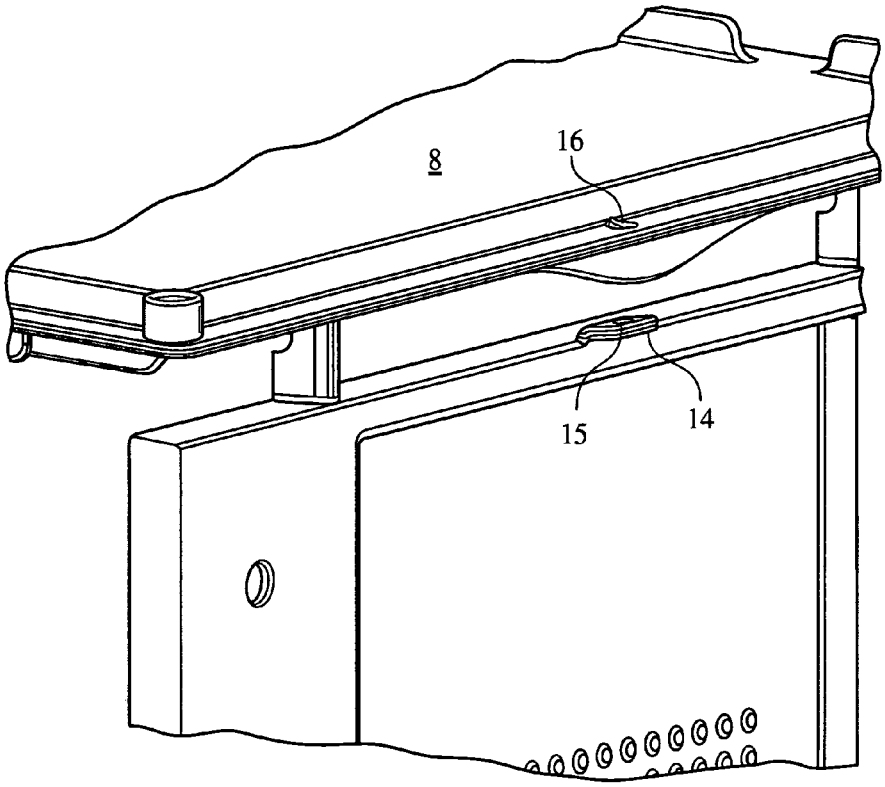
FIG. 5 shows a top part of the crosswise side wall with lid.

As is evident from FIG. 5, this bore 15 aligns with a bore 16 in the edge region of the lid 8.

Figure 6:
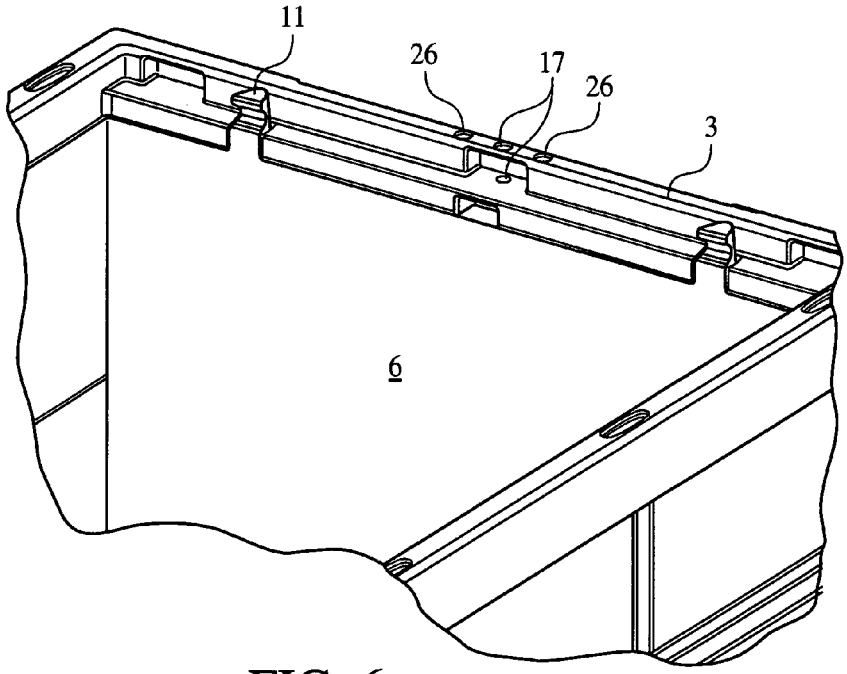
FIG. 6 shows an embodiment of a crosswise side wall with top end frame.

As is evident in FIG. 6, corresponding bores 17 are also provided in the top end frame.

Figure 7:
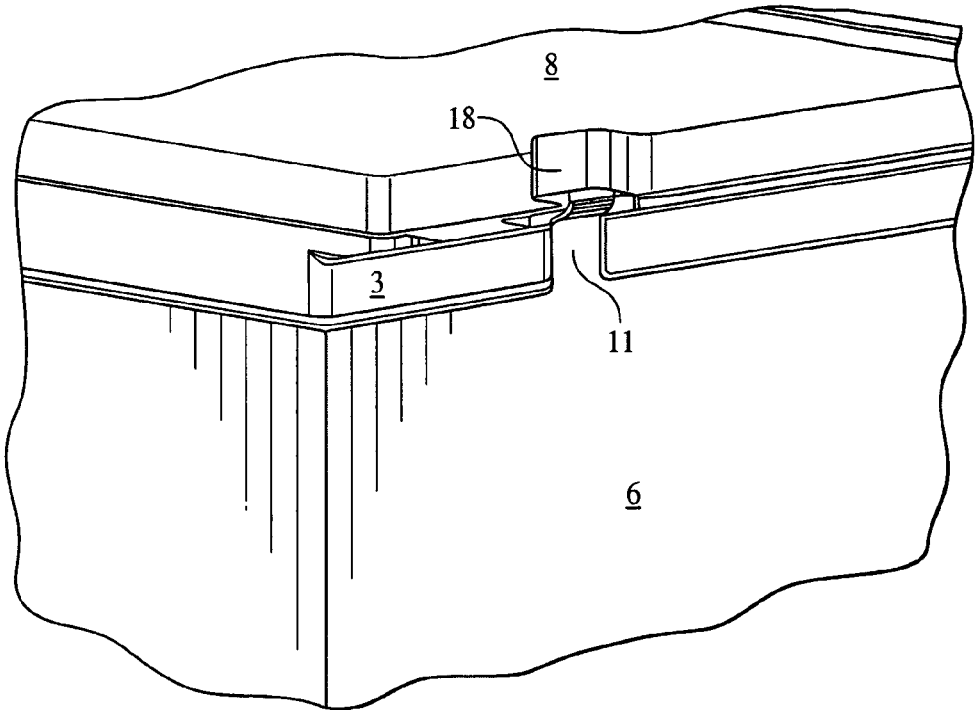
Figure 8:
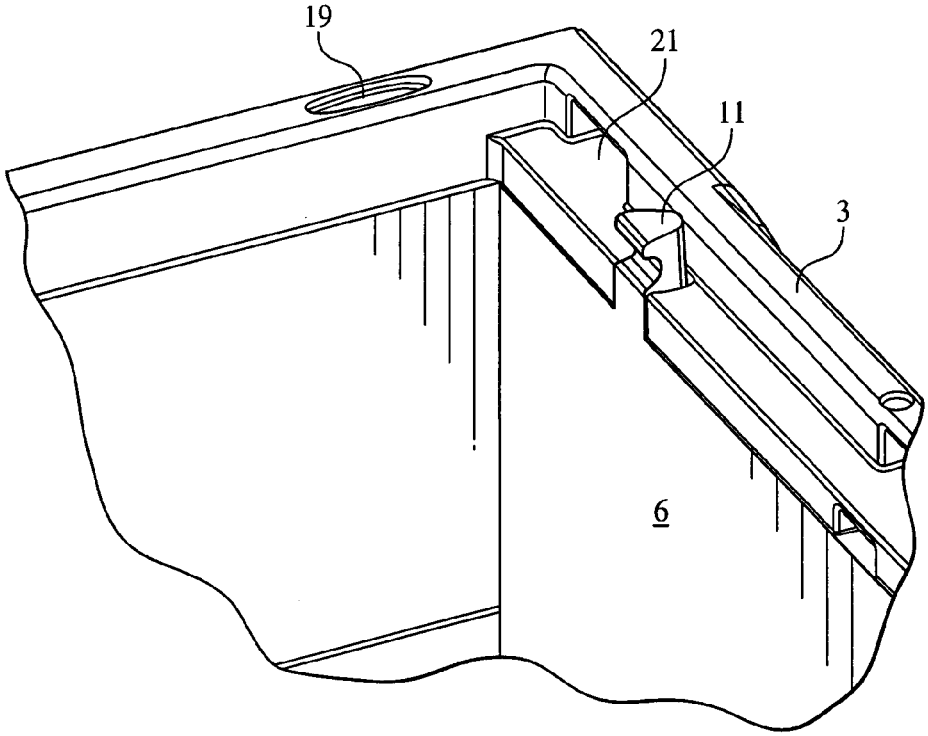
FIG. 8 shows an embodiment of a crosswise side wall and lengthwise side wall with top end frame.

In FIG. 7, it is shown how the positive-lock connection of tab 11 comes about. Tab 11 is taken into a recess 18 by the lid 8 being set on. These recesses 18 are shown more clearly in FIG. 9, which shows the underside of a crosswise side of the lid. Recesses 18 are structured in pocket shape and thereby correspond with the hook-shaped top of the tab 11, which is clearly evident from FIG. 8. In FIG. 8, slit-shaped recesses 19 are also shown in top edge region of the top end frame 3. The slit-shaped recesses 19 correspond with hook-shaped locking tabs 20 on the underside of lid 8. Other recesses 21 are provided on the crosswise sides of top end frame 3, which correspond with latches 22, which are arranged on the side of lid 8 on which pocket-shaped recesses 18 are also located.

Figure 9:
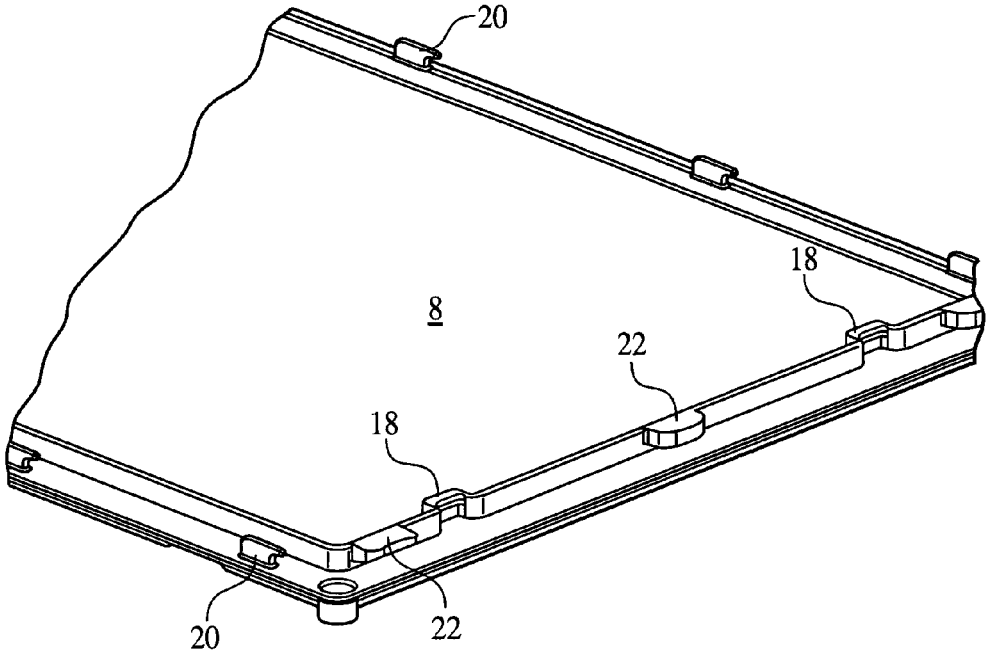
FIG. 9 shows an embodiment of a lid in a view from the bottom right side.
Figure 10:
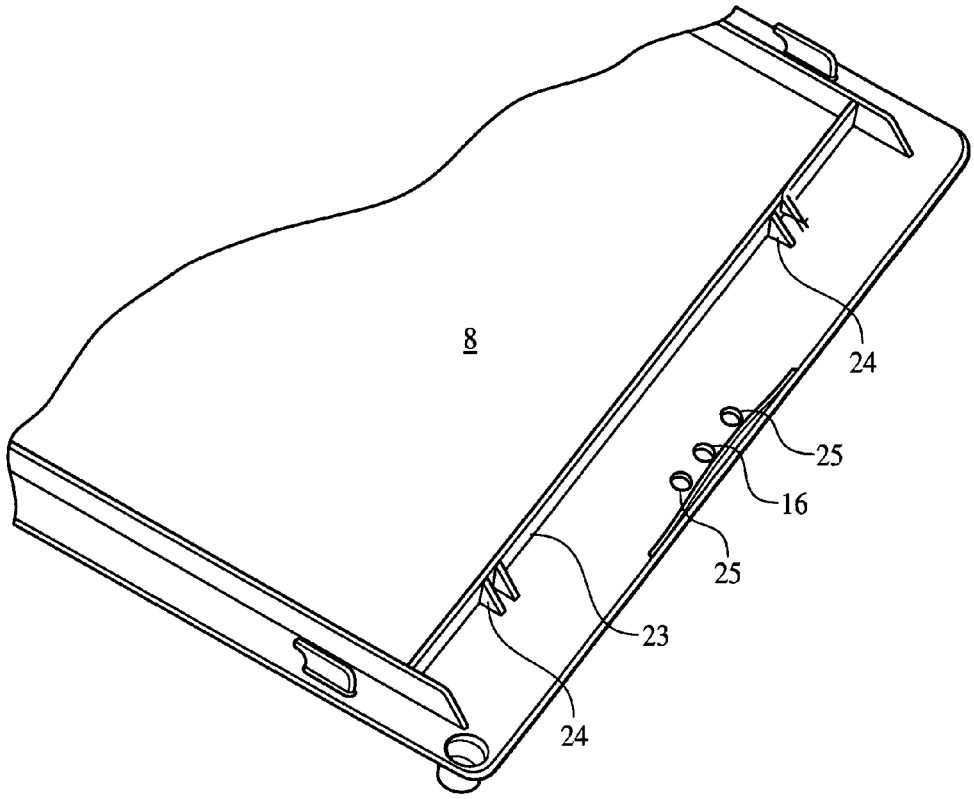
FIG. 10 shows an embodiment of a lid in a view from the bottom left side.

As is evident from FIG. 10, the opposite crosswise side of lid 8 is structured differently than the side shown in FIG. 9.

Instead of the pocket-shaped recesses 18, here only a ridge 23 is provided, which has wedge-shaped regions 24 that correspond with the tabs 11 of the opposite crosswise side wall 6 in the assembled state.

Finally, it is evident from FIG. 10 that next to the bore 16, raised nubs 25 are molded into lid 8, which correspond with recesses 26 in top end frame 3 (see FIG. 6).

In order to bring container 1 into its' operating position, the lengthwise sides 5 are first brought into their upright position. Afterwards, the two crosswise side walls 6 are brought into their upright position, so that the tabs 11 move into the corresponding recesses in top end frame 3. Then the lid 8 is set onto the top end frame 3 so that the hook-shaped tabs align with the slit-shaped recesses 19. In this position, the lid is moved vertically downward, so that the hooks 20 penetrate into the recesses 19. In this connection, the lid is shifted horizontally, at the same time, so that the hook-shaped projections of the locking tabs 20 move under the top horizontal wall of the top end frame 3, which is structured as a hollow frame, and at the same time, the pocket-shaped recesses 18 move over the hook-shaped ends of the tabs 11, and furthermore, the latches 22 penetrate into the corresponding recesses 21 of the top end frame 3.

In this connection, the nubs 25 also come into engagement with the corresponding recesses 26, so that now lid 8 is securely seated on container 1. The wire of a lead seal is then drawn through bores 15, 16, and 17.

Alternatively, instead of lid 8, a container with the same construction can also be set onto open container 1, so that the positive-lock connection comes about with tabs 11 and recesses 27 in the shoulder-shaped bottom region 2 (FIG. 1).

In this manner, several containers 1 can be stacked one above the other, so that the uppermost container 1 is then closed with lid 8. Belts can then be tightened around the entire set of containers, through recesses 10.

Figure 11:
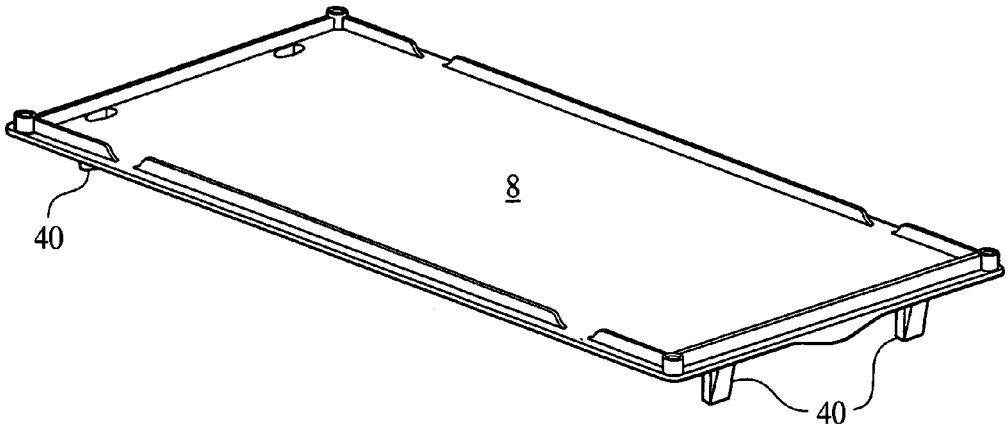
FIG. 11 shows a variant of a lid (view from the top).
Figure 12:
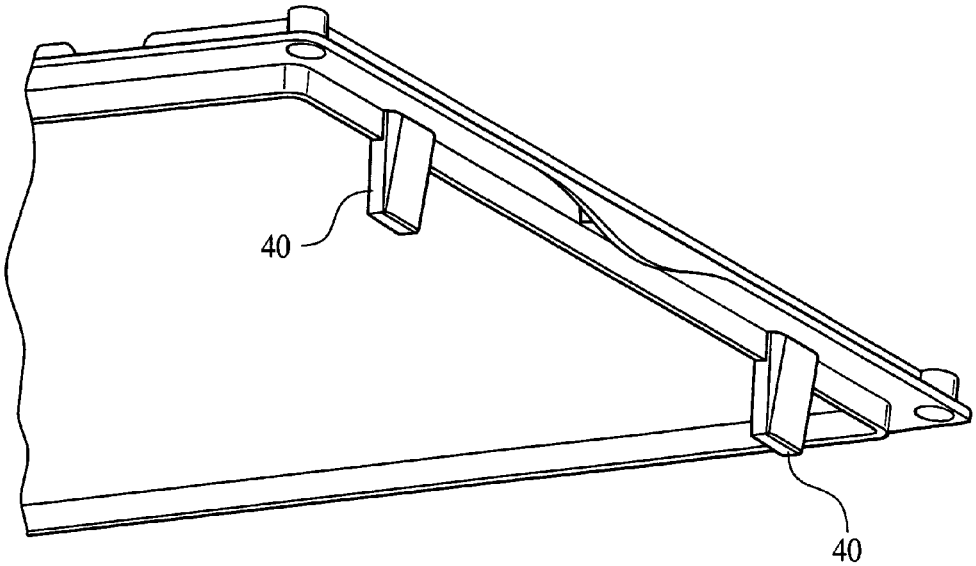
FIG. 12 shows a lid according to FIG. 11 (view from the bottom).

In FIG. 11, an alternative lid is shown. Here, lid 8 has tabs 40 that point downward at its edges. Otherwise, this lid corresponds to the embodiments described above, in its structure. In FIG. 12, these tabs 40 are shown once again, in more detail.

Figure 13:
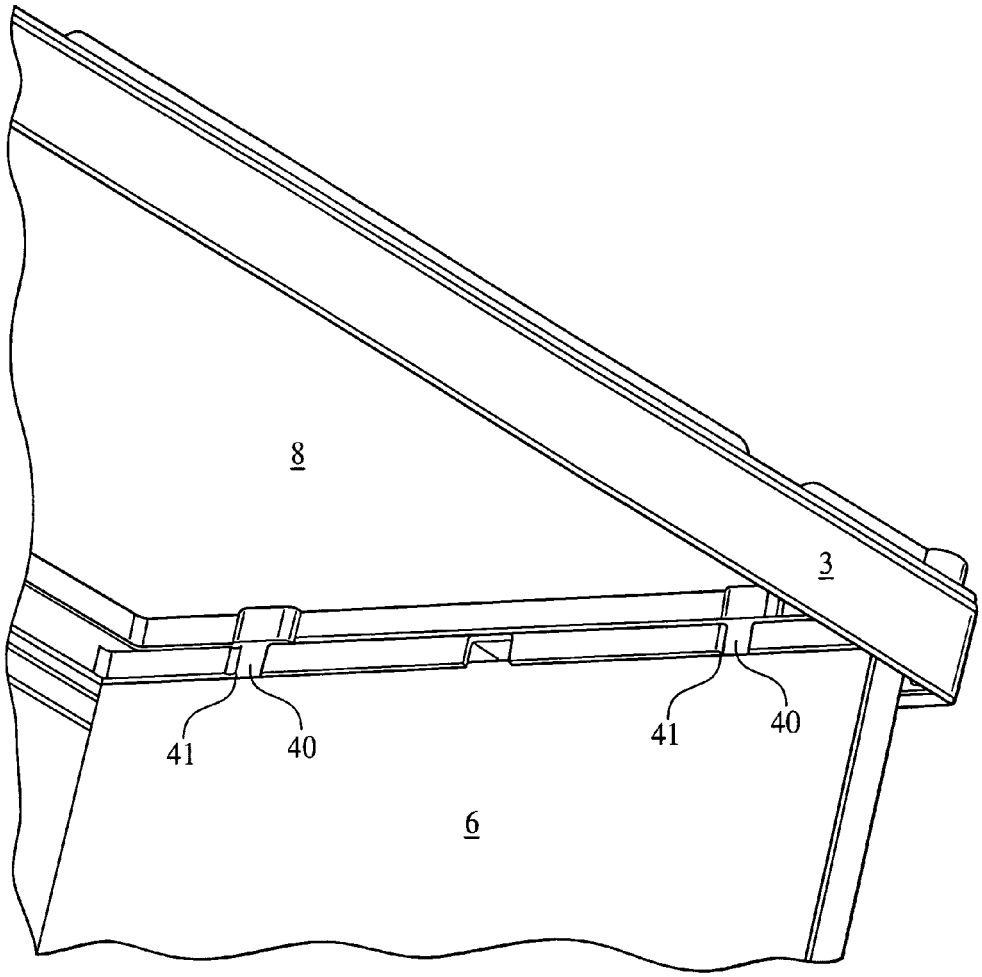
FIG. 13 shows a closed container with lid according to FIG. 11.

In FIG. 13, a cut-open container is shown, in which the crosswise side wall is set upright. There are recesses 41 in the crosswise side wall 6, into which tabs 40 of the lid 8 submerge.

Accordingly, while a few embodiments of the present invention have been shown and described, it is to be understood that many changes and modifications may be made thereunto without departing from the spirit and scope of the invention as defined in the appended claims.

What is claimed is:

1. A collapsible plastic storage and transport container comprising:

(a) a bottom extending in a plane;

(b) first and second lengthwise side walls connected to said bottom;

(c) first and second crosswise side walls connected to said bottom;

said lengthwise and crosswise side walls being adapted to assume an operating position wherein said lengthwise and crosswise side walls extend vertically from said bottom opposite one another in pairs;

(d) a top end frame connected with said lenghtwise side walls in articulated manner near top edges of said lenghtwise side walls; and (e) a lid for closing the container having an underside and a lid recess and a ridge formed on said underside;

wherein said lengthwise side walls are mounted on said bottom and on said end frame in articulated manner about longitudinal axes that run parallel to one another and to the plane of said bottom, said lengthwise side walls being adapted to fold about a center longitudinal axis;

wherein said crosswise side walls are each structured in one piece, are each provided at a top edge with a device to secure it in place with a positive lock on said top end frame, and are adapted to pivot near said bottom about a crosswise axis that is parallel to the plane of said bottom from an upright position into a horizontal collapsed position after release of the locks;

wherein said device comprises at least one tab adapted for being fastened in place in a complementary recess in the top end frame with a positive lock; and wherein the tab in the first crosswise side wall is substantially cylindrical in shape and, in the upright position of said first crosswise side wall, projects beyond the complementary recess in the top end frame into said lid recess that closes the container, while the tab in the second crosswise side wall has a protecting part that rests against said ridge.

2. The container according to claim 1, wherein two tabs are provided at each crosswise side wall.

3. The container according to claim 1, wherein each crosswise side wall has a projection that projects outward at a right angle adapted for insertion through a complementary slit in said top end frame and for being locked in place by a lead seal.

4. The container according to claim 3, further comprising:

(a) at least three aligned bores for receipt of wire of the lead seal disposed respectively in the lid, in the top end frame and in the projection, (b) a plurality of raised nubs provided to the right and the left of the bore in the lid on the underside of the lid; and (c) a plurality of depressions in the top end frame corresponding to said nubs.

5. The container according to claim 1, further comprising locking tabs provided on the underside of the lid and wherein said top end frame has a hollow profile and comprises slit-shaped recesses adapted for receipt of the locking tabs.

6. The container according to claim 5, wherein the locking tabs have a hook shape for insertion vertically into the slit-shaped recesses in the top end frame, said locking tabs adapted to engage under a top wall of the end frame after the lid has been shifted horizontally.

7. The container according to claim 1, wherein the top end frame has first and second sides associated respectively with the first and second crosswise side walls and on each of said first and second sides has a lower shoulder that points into an interior portion of the container, said shoulder having arranged therein the complementary recess for holding the tab.

8. The container according to claim 1, further comprising lid tabs that project from edges of the lid at a right angle and wherein said device comprises recesses provided in the top edge of the crosswise side walls which correspond with said lid tabs.

9. A collapsible plastic storage and transport container comprising:

(a) a bottom extending in a plane;

(b) first and second lengthwise side walls connected to said bottom;

(c) first and second crosswise side walls connected to said bottom;

said lengthwise and crosswise side walls being adapted to assume an operating position wherein said lengthwise and crosswise side walls extend vertically from said bottom opposite one another in pairs;

(d) a top end frame connected with said lengthwise side walls in articulated manner near top edges of said lengthwise side walls;

(e) a holder in said top end frame and a bottom recess in said bottom; and (f) at least one tab adapted for being fastened in place in a complementary recess in the top end frame with a positive lock wherein the tab is substantially cylindrical in shape and is adapted to project, in the upright position of the crosswise side wall, beyond the holder in the top end frame into a bottom recess in the bottom of a container that is set onto the container;

wherein said lengthwise side walls are mounted on said bottom and on said end frame in articulated manner about longitudinal axes that run parallel to one another and to the plane of said bottom, said lengthwise side walls being adapted to fold about a center longitudinal axis; and wherein said crosswise side walls are each structured in one piece, are each provided at a top edge with a device to secure it in place with a positive lock on said top end frame, and are adapted to pivot near said bottom about a crosswise axis that is parallel to the plane of said bottom from an upright position into a horizontal collapsed position after release of the lock.

* * * * *

UNITED STATES PATENT AND TRADEMARK OFFICE

CERTIFICATE OF CORRECTION

PATENT NO. : 7,137,522 B2
APPLICATION NO. : 10/694488
DATED : November 21, 2006
INVENTOR(S) : Dubois It is certified that error appears in the above-identified patent and that said Letters Patent is hereby corrected as shown below:

Column 5, lines 37 and 39 (Lines 1 and 3 of subparagraph (d) in Claim 1), please change “lenghtwise” to correctly read: --lengthwise--.
In Column 5, line 54 (Line 7 of the second “wherein” paragraph in Claim 1), please change “locks” to correctly read: --lock--.

Signed and Sealed this

Sixth Day of March, 2007

JON W. DUDAS
*Director of the United States Patent and Trademark Office*